United States Patent [19]

Hodgkin

[11] 4,442,678

[45] Apr. 17, 1984

[54] VAPOR GENERATING AND VAPOR SUPERHEATING INSTALLATIONS

[75] Inventor: Alan F. Hodgkin, Bovingdon, England

[73] Assignee: Babcock Power Limited, London, England

[21] Appl. No.: 324,979

[22] Filed: Nov. 25, 1981

[30] Foreign Application Priority Data

Nov. 26, 1980 [GB] United Kingdom ..... 8037926

[51] Int. Cl.[3] ..... F01K 15/00

[52] U.S. Cl. ..... 60/676; 60/715; 60/716; 60/652; 60/653

[58] Field of Search ..... 122/4 D; 60/652, 676, 60/716, 715, 653

[56] References Cited

U.S. PATENT DOCUMENTS 4,085,593 4/1978 Larsen ..... 60/676

*Primary Examiner*—Allen M. Ostrager

*Attorney, Agent, or Firm*—Kemon & Estabrook

[57] ABSTRACT

A vapor generating and vapor superheating installation for marine propulsion purposes, and a method of operating such an installation. The installation including a vapor generating and vapor superheating unit adapted to be fired with fluent fuel including tubulous vapor generating and vapor superheating surface proportioned to give a predetermined superheated vapor output at a maximum firing rate. The installation also including a fluent fuel fired fluidized bed furnace provided with a superheater tube bank connected to receive vapor from the vapor generating and vapor superheating unit and arranged to impart superheat to the vapor at part load operation of the unit.

4 Claims, 1 Drawing Figure

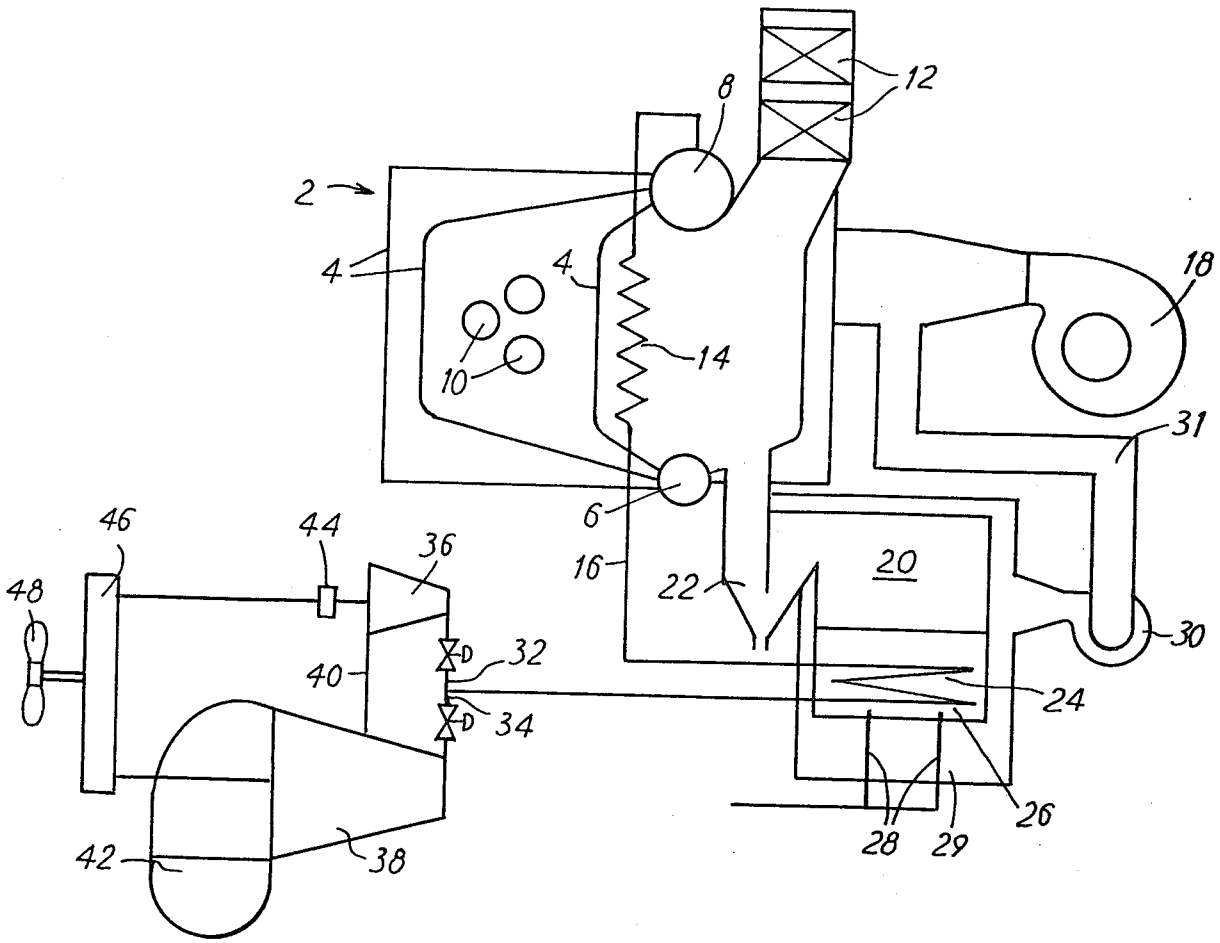
18
31
30
24
26
29
28
20
12
8
14
22
6
16
4
10
32
34
36
38
2
4
44
40
46
42
48

VAPOR GENERATING AND VAPOR SUPERHEATING INSTALLATIONS

DESCRIPTION

This invention relates to vapour generating and vapour superheating installations and, more particularly, to installations utilised for marine propulsion purposes.

According to the present invention there is provided a vapour generating and vapour superheating installation including a vapour generating and vapour superheating unit adapted to be fired with fluent fuel including tubulous vapour generating and vapour superheating surfaces proportioned to give a predetermined superheated vapour output at a maximum firing rate and a fluent fuel fired, fluidised bed furnace provided with a superheater tube bank connected to receive vapour from the vapour generating and vapour superheating unit and arranged to impart superheat to the vapour at part load operation of the unit.

The invention also includes a method of generating superheated vapour at a predetermined degree of superheat at a high volume flow rate in directly fired tubulous vapour generating and vapour superheating surfaces and at an intermediate volume flow rate in the directly fired tubulous vapour generating and vapour surfaces together with tubulous vapour superheating surfaces immersed in a fluent fuel fired fluidised bed.

The invention will now be described, by way of example, with reference to the accompanying diagrammatic drawing of a marine propulsion installation. The installation includes a boiler 2 having evaporator tube surfaces 4 extending between a lower header 6 and a steam and water drum 8. The boiler is fired with oil burners 10, and the combustion gases are discharged from the boiler over economiser tube banks 12. Steam from the steam and water drum 8 is superheated in a superheater 14 prior to discharge through a manifold 16. A forced draft fan 18 discharges air at superatmospheric pressure to windboxes (not shown) associated with the oil burners 10.

A fluidised bed furnace 20 is positioned adjacent the boiler and discharges combustion gases through a hopper-bottomed, grit arresting, outlet 22 to the boiler downstream of the economiser tube banks 12. A superheater tube bank 24 is positioned in a sand and/or limestone bed portion 26 of the furnace 20, which bed portion is supplied with residual type fuel oil through nozzles 28 and combustion air from a windbox 29 connected to a booster fan 30 receiving air from the forced draft fan 18 through a duct 31. The superheater tube bank 24 is connected to receive steam from the manifold 16 and discharge superheated steam to valved inlets 32, 34 respectively of a cruise turbine 36 and a main turbine 38. The cruise turbine 36 exhausts to a low pressure inlet 40 to the main turbine, which discharges to a condenser 42. The cruise turbine 36 is connected through clutch means 44 to a gearbox 46 and the main turbine 38 is connected directly to the gearbox, output from which drives a screw propeller 48.

In operation, at full, or sprint load, the oil burners 10 are fired at maximum capacity to produce the relatively large quantity of steam required at a superheat temperature of, say, just below 500° C. The steam is discharged through the manifold 16, without further superheating in the fluidised bed furnace 20, to the valved inlet 34 to the main turbine 38.

At intermediate, or cruise, loads the firing of the oil burners 10 is reduced accordingly, with the result that the superheat temperature of the steam discharged through the manifold 16 falls below that required for optimum efficiency. The fluidised bed furnace 20 is then brought into operation to raise the superheat temperature to between 550° C. and 600° C. and such superheated steam is discharged through the valved inlet 32 to the cruise turbine 36. The cruise turbine 36 is of compact form compared with the main turbine 38 and is designed for sustained cruising operation at the higher steam superheater temperature. The cruise turbine drives the gearbox 46 through the clutch 44 and discharges to the reheat section of the main turbine, thereby facilitating bringing the main turbine on load in a short time.

Since the heat transfer characteristics of a tube bank immersed in a fluidised bed are relatively high, the fluidised bed furnace may be of relatively small dimension and as such is well suited for utilisation in a shipboard installation where space is at a premium. Furthermore, combustion of the so-called residual type fuel oil in the fluidised bed furnace reduces the likelihood of high temperature attack of the tube surfaces arising from the presence of vanadium and other compounds.

Since the majority of the vessel's steaming life is at the cruise load efficiency is important and this is aided by the higher steam temperature used in the cruise turbine 36, which itself discharges into the later stages of the main turbine 38. At full power, efficiency is sacrificed accepting the lower steam temperature thus permitting the fluidised bed furnace 20 to be designed for the much lower fuel and air flow corresponding to cruise load.

I claim:

1. A marine propulsion apparatus having a vapour generating and vapour superheating installation including a vapour generating and vapour superheating unit adapted to be fired with fluent fuel and provided with tubulous vapour generating and vapour superheating surfaces proportioned to deliver a vapour output of predetermined superheat when operated at a maximum firing rate through first conduit means to an inlet to a main load turbine, the apparatus further having a fluent fuel fired, fluidised bed furnace provided with a superheater tube bank connected to receive vapour from the vapour generating and vapour superheating unit arranged to impart superheat to the vapour at part load operation to the unit and deliver superheated vapour through a second conduit means to an inlet to an intermediate load turbine, and first and second valve means respectively disposed in the first and second conduit means selectively to connect the inlet of the main load turbine to the vapour generating and superheating unit and the inlet of the intermediate load turbine to the superheater tube bank in the fluidised bed furnace.

2. A marine propulsion apparatus as claimed in claim 1, wherein the fluidised bed is connected to receive fluidising and combustion air from a bleed in a primary air supply to the vapour generating and vapour superheating unit through booster fan means.

3. A marine propulsion apparatus as claimed in claim 1 or claim 2, wherein the intermediate load turbine is connected to exhaust to an intermediate stage of the main turbine.

4. A method of operating a marine propulsion unit including selectively supplying superheated vapour to a main load turbine and to an intermediate load turbine, producing superheated vapour for supply to the main load turbine in a fluent fuel fired vapour generating and vapour superheating unit, producing superheated vapour for supply to the intermediate load turbine by superheating in a fluent fuel fired fluidised bed furnace vapour generated and partially superheated in the vapour generating and vapour superheating unit and discharging vapour from the intermediate load turbine to an intermediate stage of the main load turbine.

* * * * *